United States Patent [19]

Johnson

[11] Patent Number: 4,706,758

[45] Date of Patent: Nov. 17, 1987

[54] AUTOMATIC ON-OFF SPRINKLER HEAD

[75] Inventor: Wilfred V. Johnson, Oxford, Mass.

[73] Assignee: U.S. Fire Control Corporation, Mass.

[21] Appl. No.: 863,490

[22] Filed: May 15, 1986

Related U.S. Application Data

[63] Continuation-in-part of Ser. No. 605,201, Aug. 30, 1984, abandoned.

[51] Int. Cl.[4] ..... A62C 37/06

[52] U.S. Cl. ..... 169/19; 169/90

[58] Field of Search ..... 169/37–41, 169/90, 19, 42; 137/79

[56] References Cited

U.S. PATENT DOCUMENTS

| | | | |
|---|---|---|---|
| 608,677 | 8/1898 | Hibbard | 137/79 X |
| 1,107,845 | 8/1914 | Sackett | 169/37 |
| 3,874,455 | 4/1975 | Klesow | 169/19 |
| 3,924,687 | 12/1975 | Groos | 169/19 |
| 4,015,665 | 4/1977 | Simons et al. | 169/40 |
| 4,283,823 | 8/1981 | Buswell | 236/34.5 X |

*Primary Examiner*—Andres Kashnikow
*Assistant Examiner*—Daniel R. Edelbrock
*Attorney, Agent, or Firm*—John E. Toupal; Harold G. Jarcho

[57] ABSTRACT

An automatic on-off fire extinguishing sprinkler head including a housing defining inlet and outlet openings; a valve retained by the housing and disposed between the inlet and outlet openings, the valve being movable between a closed position in which it prevents fluid flow between the inlet and outlet openings and an open position in which it allows fluid flow therebetween and a latch releasably latching the valve in the closed position. A release mechanism responds to a sensor by releasing the latch to allow movement of the valve into the open position at a predetermined ambient temperature. Operatively coupled to the valve is a temperature responsive actuator shaped and arranged to allow movement of the valve into its open position in response to ambient temperatures above a given level and to force the valve into its closed position in response to ambient temperatures below the given level.

18 Claims, 5 Drawing Figures

AUTOMATIC ON-OFF SPRINKLER HEAD

CROSS-REFERENCE TO RELATED APPLICATION

This application is a continuation-in-part of abandoned U.S. patent application Ser. No. 06/605,201, "Automatic On-Off Sprinkler Head" filed on Aug. 30, 1984.

BACKGROUND OF THE INVENTION

This invention relates generally to a fire extinguishing sprinkler valve and, more particularly, to an on-off fire extinguishing sprinkler valve.

One type of known on-off sprinkler head employs a temperature responsive actuator to control the pressure in a pilot volume disposed on one side of a piston valve and communicating with a water supply applying pressure to the opposite side of the valve. In response to variations in ambient temperature the pressure in the pilot volume changes relative to the supply pressure and thereby causes desired opening and closing operation of the valve. Examples of pilot volume actuated on-off sprinkler heads are disclosed in U.S. Pat. Nos. 3,702,160; 3,746,098; 3,748,176; 3,757,866 and 4,359,098. Individual and collective disadvantages of pilot volume valves include structural complexity, leak prone movable seals, dependence on differential pressure actuation, etc.

Another type of on-off sprinkler head employs a temperature responsive actuator such as a wax motor to directly operate a flow valve. Examples of directly operated sprinkler heads are disclosed in U.S. Pat. Nos. 3,734,191; 3,802,510 and 3,911,940. Disadvantages of directly actuated heads include a requirement for spring members to effect valve closures and a relatively slow response of the direct actuators. The latter deficiency can be obviated by a sprinkler head disclosed in U.S. Pat. No. 3,924,687 and which used a conventional fusible link actuated straight on valve in series with a directly actuated on-off sprinkler valve. By selecting a melting temperature for the fusible link that is higher than the actuation temperature of the direct actuator, the on-off valve can be made to positively and completely open prior to opening of the straight-on valve. The sprinkler head disclosed in U.S. Pat. No. 3,924,687 exhibits the cost and complexity disadvantages inherent in a head employing two distinct valves.

SUMMARY OF THE INVENTION

The invention is an automatic on-off fire extinguishing sprinkler head including a housing defining inlet and outlet openings; a valve retained by the housing and disposed between the inlet and outlet openings, the valve being movable between a closed position in which it prevents fluid flow between the inlet and outlet openings and an open position in which it allows fluid flow therebetween and a latch releasably latching the valve in the closed position. A release mechanism responds to a sensor by releasing the latch to allow movement of the valve means into the open position at a predetermined ambient temperature. Operatively coupled to the valve is a temperature responsive actuator shaped and arranged to allow movement of the valve into its open position in response to ambient temperatures above a given level and to force the valve into its closed position in response to ambient temperatures below the given level. The temperature responsive actuator insures positive, predictable closure of the valve without any requirement for bias members.

According to one feature of the invention, the predetermined temperature is greater than the given temperature level. A lower predetermined temperature insures that the actuator will be operational when the desired given actuation temperature is reached.

According to another feature of the invention, the temperature responsive actuator comprises a shape-memory alloy member and the latch is shaped and arranged to relatch the valve in the closed position in response to movement thereinto produced by the alloy member. The shapememory alloy member provides a susbstantial force that insures positive closure of the valve.

According to still other features of the invention, the valve comprises a valve head disposed in so as to fluid tightly seal the outlet opening when in its closed position and a support fixed to the valve head and movably retained by the housing; the alloy is operatively coupled between the housing and the support which is shaped and arranged to allow movement of the valve head into its open position spaced apart from the outlet opening; the valve further comprises a deflector projecting circumferentially from the valve head and adapted to deflect fluid discharging from the outlet opening in a predetermined pattern, and the housing defines a rectilinear fluid flow passage between the inlet and outlet openings, an annular chamber surrounding the passage, and heat exchange openings allowing air circulation into the chamber which retains the alloy member. These features provide desirable fire extinguishing capability.

According to additional features of the invention, the alloy member is a coil retained in the chamber and surrounding the passage, the coil member tending to assume either a contracted or an expanded state in response to ambient temperature, the latch comprises latch arms retained by the housing and shaped and arranged to engagably secure the valve when in a latched position and to allow movement thereof when in a released position, the release is retained by the valve means and adapted to move the latch arms into the released position in response to sensing of the predetermined ambient temperature by the sensor which is retained by the valve, the deflector comprises inner and outer surfaces, the inner surface being disposed adjacent to the housing with the valve in its closed position and the outer surface engaged by the latch arms; and the release comprises a pair of release rods reciprocably mounted on the outer surface and adapted to engage and move the latch arms into the released position in response to sensing of the predetermined temperature by the sensor. These features provide a compact easily produced structure.

According to still other features of the invention, the latch arms engage diametrically opposed positions on the outer surface, the release rods are rectilinearly aligned and have inner ends spaced apart thereon, and the sensor comprises a piston shaped and arranged to engage the inner ends and move the outer ends of the rods into engagement with the latch arms in response to sensing of the predetermined temperature. This arrangement facilitates the required release action.

According to one embodiment of the invention, the alloy coil assumes the contracted state in response to ambient temperatures above the given level and assumes the expanded state in response to ambient temperatures therebelow, the housing further defines a housing retainer portion, the support comprises a coil retainer portion that moves toward the housing retainer portion during movement of the valve means to the open position, and the coil member is disposed between the housing retainer portion and the coil retainer portions. In this embodiment, expansion of the alloy coil closes the valve when ambient temperature falls below the given level.

According to another embodiment of the invention the alloy coil tends to assume its expanded state in response to ambient temperatures above said given level and assumes its contracted state in response to ambient temperatures therebelow, the housing further defines a housing retainer portion, the support comprises a coil retainer portion, and the alloy coil has one end fixed to said housing retainer portion and an opposite end fixed to the coil retainer portion. In this embodiment, contraction of the alloy coil closes the valve when ambient temperature falls below the given level.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
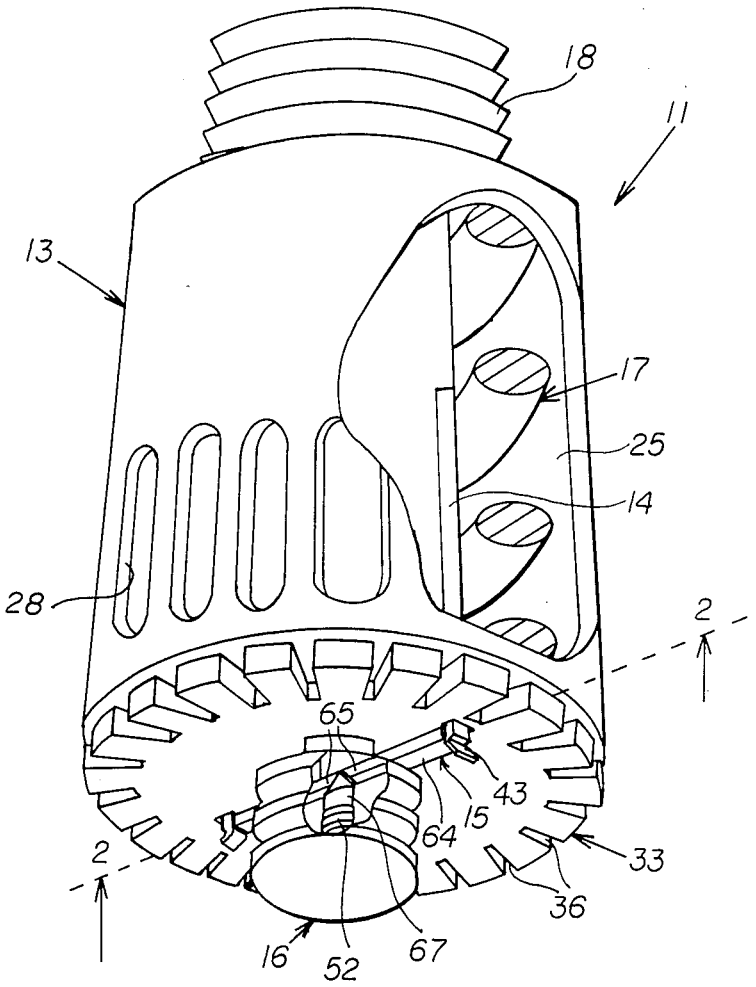
FIG. 1 is a partially cut away perspective view of a sprinkler head according to the invention and shown in an inactive position.

Illustrated in FIGS. 1–4 is an automatic sprinkler head embodiment 11 constructed in accordance with the invention. The head 11 includes a valve mechanism 12 retained by a housing 13 and movable with respect thereto between a closed position shown in FIG. 1 and an open position shown in FIG. 4. Also included in the head 11 are a pair of latch arms 14 retained by the housing 13 and an actuator mechanism 15 and a temperature sensor 16 both retained by the valve 12. Another component of the head 11 is a shape-memory alloy coil 17 that is operatively coupled between the housing 13 and the valve 12. Suitable shape-memory alloys are described in an article "SME brass-a new engineering material" by A. D. Michael and W. B. Hart in The Metallurgist and Materials Technologist, Vol. 12, No. 8, August 1980; an article "A copper alloy's memory helps conserve energy" in INCRA, published in February 1980, No. 10 by International Copper Research Association, Inc.; and a manual "A Design Manual for Actuators using Shape Memory Effect Brass" published by Delta Memory Metal Ltd. of Ipswich, Suffolk, England. Functional relationships between the components 12–17 of the embodiment 11 are described in detail hereinafter.

The housing 13 includes a tubular portion 18 that defines a rectilinear flow passage 19 extending between an inlet opening 21 and an outlet opening 22. An upper end of the tubular portion 18 is threaded to accommodate assembly into a supply system (not shown) for supplying a suitable fire extinguishing fluid such as water. Also included in the housing 13 is an outer cylinder 24 that surrounds the tubular portion 18 and is radially spaced therefrom to form therewith an annular chamber 25. An upper end of the cylinder 24 defines an inwardly projecting collar portion 26 that engages the tubular portion 18. Joining the bottom ends of the tubular portion 18 and the cylinder 24 is an annular retainer disc portion 27 of the housing 13. A plurality of circumferentially spaced apart heat exchange openings 28 are defined by the outer cylinder 24. Conforming to the inner surface of the tubular portion 18 is a thermal insulator sleeve 29 that separates the chamber 25 from the flow passage 19.

Figure 2:
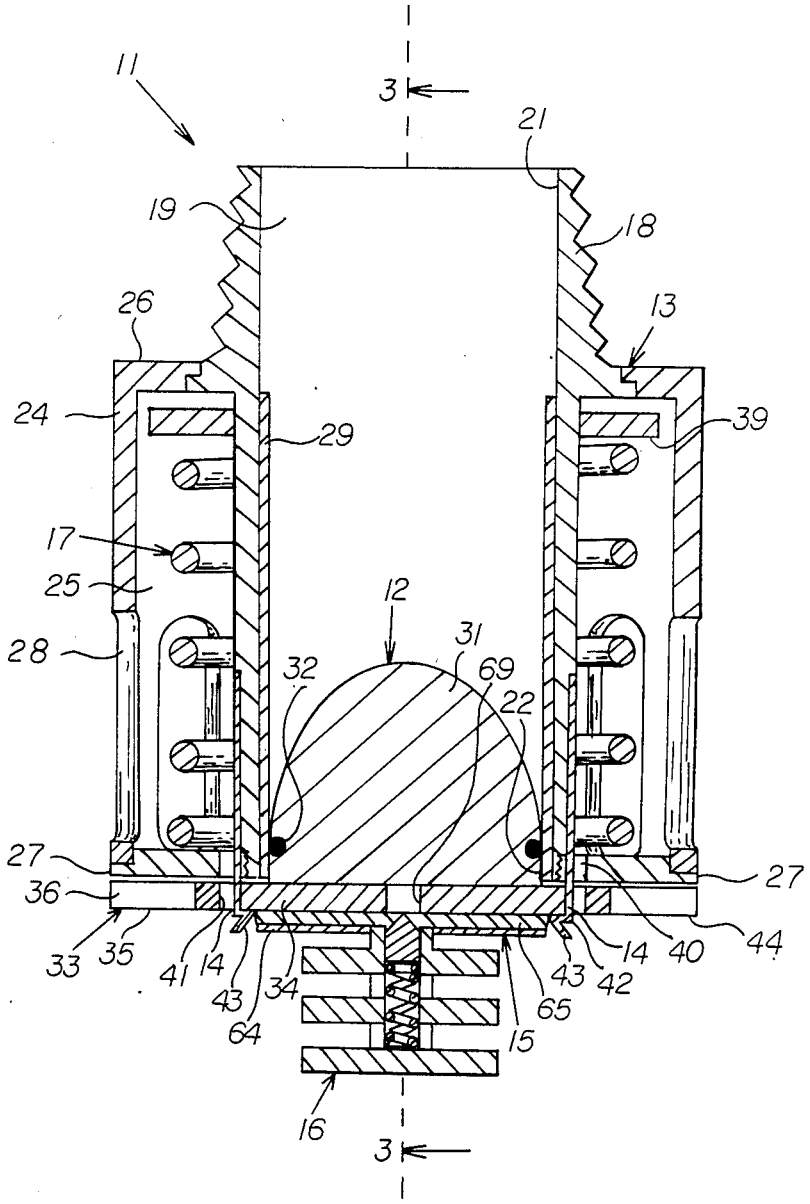
FIG. 2 is a schematic cross-sectional view taken along lines 2—2 of FIG. 1.
Figure 3:
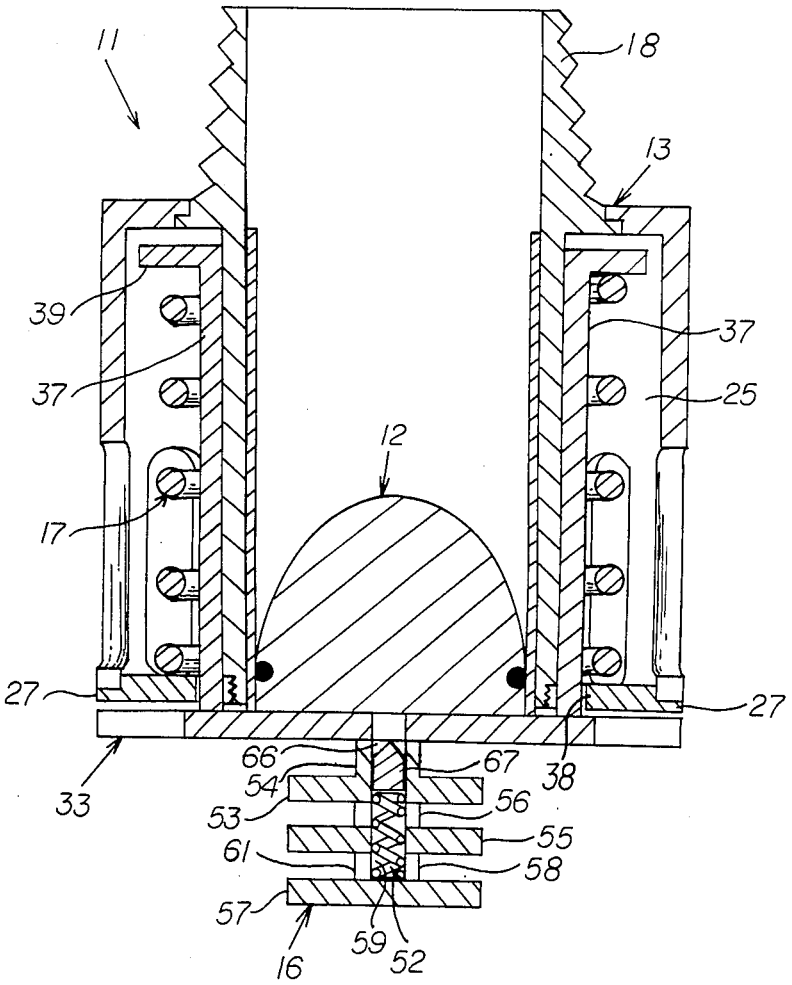
FIG. 3 is a schematic cross-sectional view taken along lines 3—3 of FIG. 2.
Figure 4:
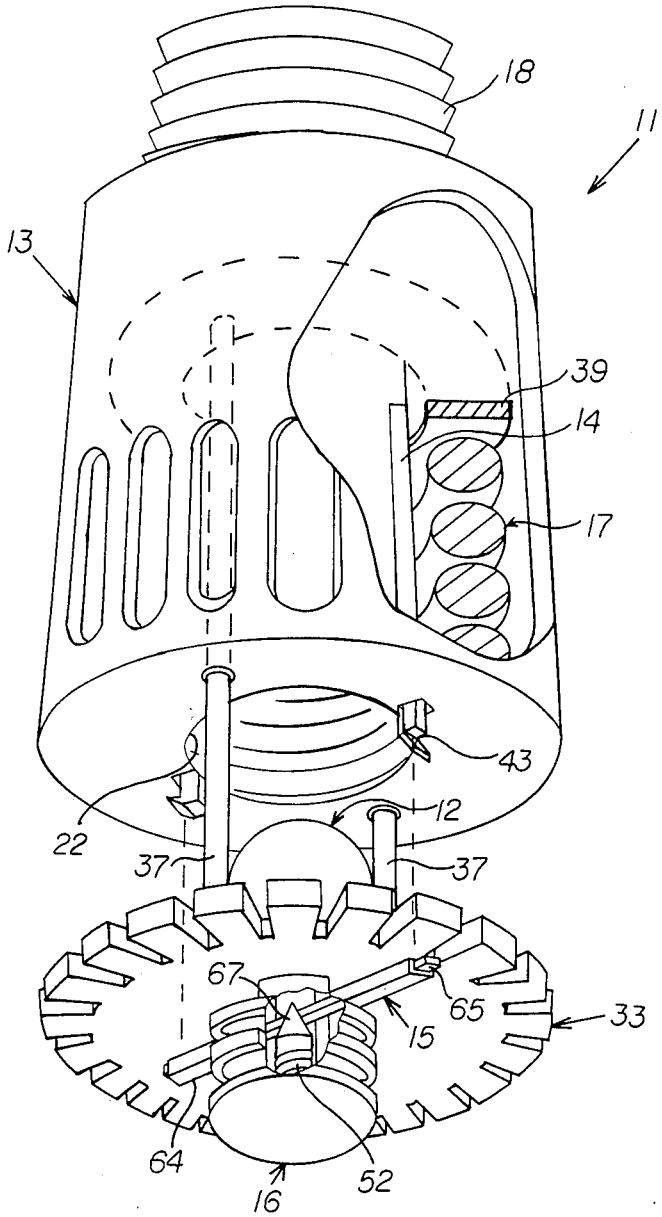
FIG. 4 is a partially cut away perspective view similar to that shown in FIG. 1 but with the sprinkler head in an active position.

The valve 12 includes a semi-spherically shaped valve head 31 that in a closed position is disposed in the lower portion of the flow passage 19 as shown in FIGS. 1–3. Retained by the valve head 31 is an o-ring 32 that engages the inner surface of the sleeve 29 to provide a fluid tight seal for the outlet opening 22 with the valve in a closed position. Also included in the valve 13 is a circular deflector plate 33 having a central portion 34 fixed to an outer surface of the valve head 31 and an outer portion 35 disposed closely adjacent to the housing retainer disc 27 with the valve in the closed position shown in FIGS. 1–3. Formed in the outer deflector portion 35 are a plurality of circumferentially spaced apart deflector openings 36 that establish a predetermined fluid distribution pattern after opening of the valve 12. Additional components of the valve 12 are a pair of support struts 37 longitudinally disposed in diametrically spaced apart positions within the annular chamber 25. Lower portions of the struts 37 extend through slots 38 in the retainer disc 27 and have ends fixed to the inner surface of the deflector plate 33. Upper portions of the struts 37 terminate with an outwardly projecting, annular coil retainer flange portion 39.

The resilient latch arms 14 are retained by diametrically disposed longitudinal recesses in the outer surface of the tubular body 18. Upper portions of the latch arms 14 are fixed to the tubular body 18 while lower portions are detached so as to be resiliently deflectable outwardly with respect thereto. The lower portions of the latch arms 14 extend through slots 40 in the retainer disc 27 and apertures 41 in the deflector plate 33. Terminating the latch arms 14 are inwardly directed hook portions 42 that engage an outer surface 44 of the deflector plate 33 with the valve 12 in its closed position. Cam portions 43 of the latch arms 14 are inclined outwardly and downwardly from the inner ends of the hook portions 42.

Included in the sensor 16 is a heat collector assembly and a shape-memory alloy coil 52 retained thereby. The heat collector assembly includes an upper disc member 53 with a hollow hub portion 54 fixed to the outer surface 44 of the deflector plate 33, an intermediate disc member 55 spaced from the upper disc 53 and having a hollow hub portion 56 fixed thereto, and a lower disc member 57 having a hollow hub portion 58 with an upper end fixed to the intermediate disc member 55 and a lower end closed by the lower disc member 57. The hollow hub oortions 54, 56 and 58 form a cylindrical chamber 59 that retains the shape-memory alloy coil 52. Formed in the intermediate and lower hub portions 56, 58 are a plurality of openings 61 that provide communication into the cylindrical chamber 59.

The actuator assembly 15 includes a pair of rectilinearly aligned and rectangularly shaped enclosures 64 that are fixed to the outer surface 44 of the deflector plate 33. The inner ends of the rectangular enclosures 64 abut the hub 54 of the upper disc member 63. Slidably retained by each of the rectangular enclosures 64 is a rod 65 having outer ends that engage the innermost extremities of the hook portions 42 with the valve 12 in a closed position. Tapered inner ends 66 of the rods 65 engage a conically shaped end of a piston member 67 retained by the hollow hub 54 of the upper disc member 53 and aligned with a centrally located opening 69 in the deflector plate 33.

Figure 5:
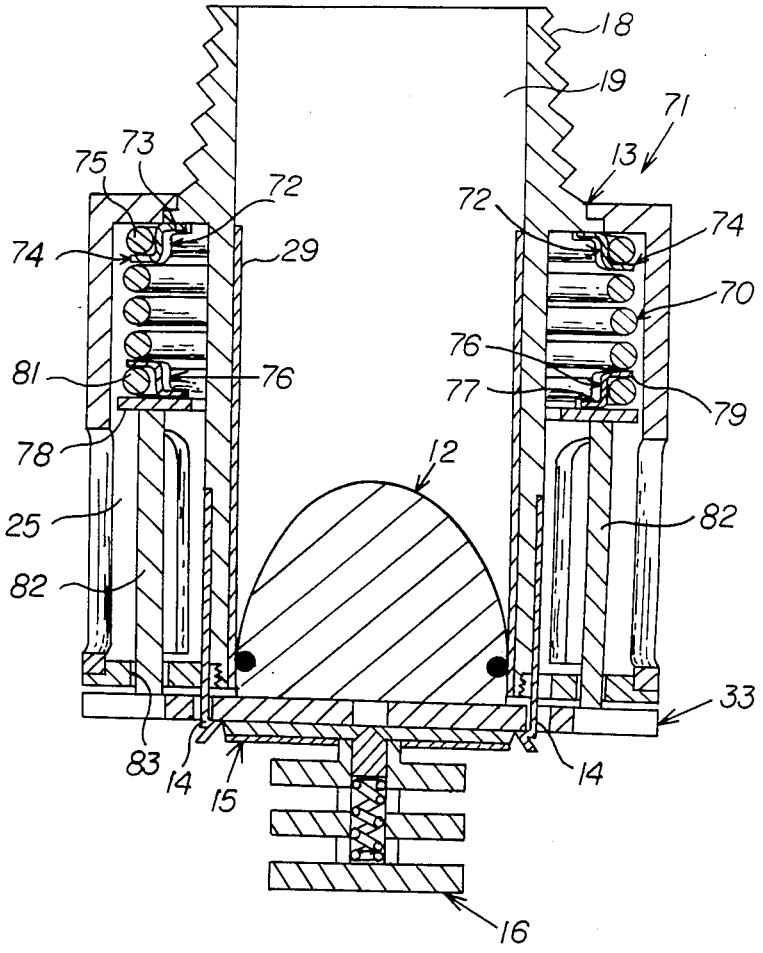
FIG. 5 is a schematic cross-sectional view of a modified sprinkler head according to the invention.

FIG. 5 shows another automatic sprinkler head embodiment 71 in which components corresponding to those in the embodiment 11 depicted in FIGS. 1–4 bear identical reference numerals. In the embodiment 71, a pair of housing retainer brackets 72 have inwardly projecting portions 73 fixed to the housing 13 and lower outwardly projecting portions 74 that retain a top turn 75 of the shape-memory alloy coil 70. A pair of lower support brackets 76 have lower, inwardly directed portions 77 fixed to an annular disc 78 and upper outwardly directed portions 79 that retain a bottom turn 81 of the coil 70. A pair of struts 82 are disposed in diametrically opposed positions within the annular chamber 25 and have upper ends fixed to the annular disc 78. Lower portions of the struts 82 extend through apertures 83 in a lower housing disc portion and terminate with ends fixed to the deflector plate 33.

OPERATION

Installation of the sprinkler head 11 in a protected zone involves engagement of the tubular body 18 with a mating threaded coupling (not shown) of a supply system for a suitable fire extinguishing fluid such as water. After installation and in the absence of ambient temperature indicating the existence of combustion within the protective zone, the sprinkler head 11 remains in its inactive state with the valve 12 closed as illustrated in FIGS. 1–3. The shape-memory alloy coil 17 is expanded during this period extending between the housing retainer disc portion 27 and the coil retaining flange 39 as shown. In response to a fire within the protected zone, however, the ambient temperature rises and air flow through the heat exchange openings 28 into the annular chamber 25 produces a corresponding increase in the temperature of the alloy coil 17. At an ambient temperature above a given level, for example 120° F., the transition temperature of the alloy coil 17 is reached causing it to contract into a form having an axial length substantially less than the spacing between the housing retainer disc 27 and the coil retaining flange 39. However, the valve 12 is retained in a closed position by the latch arms 14, the hook portions 42 of which remain engaged with the outer surface 44 of the deflector plate 33.

A further rise in ambient temperature to some predetermined level, for example 135° F., exceeds the transition temperature of the sensor alloy coil 52 causing it to expand axially within the chamber 59. Heat transfer into the chamber 59 is enhanced by air flow through the openings 61 in the hub portions 56, 58. Expansion of the sensor alloy coil 52 forces the piston 67 upwardly into the opening 68 in the deflector plate 33. This movement of the piston 67 separates the rods 65 causing the outer ends thereof to forcably engage the hook portions 42. The resultant outward deflection of the latch arms 14 disengages the hook portions 42 from the outer surface of the deflector plage 33. Accordingly, the released valve 12 assembly is moved by the fluid pressure within the passage 19 into its open position shown in FIG. 4. During movement of the valve assembly 12 into its open position, corresponding longitudinal motion of the deflector disc 33 relative to the hook portions 42 is accommodated by the apertures 41 and longitudinal motion of the struts 37 is accommodated by the slots 38 in the retainer disc 27. The required longitudinal movement of the struts 37 that accompanies opening of the valve 12 is allowed by the prior contraction of the alloy coil 17. After opening of the valve assembly 12, extinguishing fluid supplied to the inlet opening 21 is discharged through the outlet opening 22 into the protected zone. The discharging fluid is dispersed by the deflector plate 33 to provide a desired distribution pattern. During the fluid discharge period, the insulator tube 29 thermally isolates that portion of the tubular body 18 that defines the inner surface of the annular chamber 25. The resultant reduction in heat transfer between the discharging fluid and the annular chamber 25 ensures against a premature expansion of the alloy coil 17.

Extinguishment of the fire within the protected zone normally is accompanied by a reduction in ambient temperature. When the temperature drops below the predetermined transition temperature of the sensor coil 52, it assumes its previous contracted state allowing the piston 67 to withdraw back into the chamber 59. A further reduction in ambient temperature to below the given transition level of the alloy coil 17 causes expansion thereof into the expanded form shown in FIGS. 2 and 3. This expansion of the alloy coil 17 exerts a force between the housing retainer disc 27 and the coil retainer flange 39 moving the flange and the struts 37 upwardly in the annular chamber 25. The upward movement of the struts 37 pulls the attached valve assembly 12 into its closed position sealing the outlet opening 22 and thereby terminating the flow of extinguishing fluid. Just prior to full closure of the valve 12, the inner surface of the deflector plate 33 engages the cam portions 43 and forces the latch arms 14 outwardly permitting passage thereof through the apertures 41. After the valve assembly 12 reaches its fully closed position, the resilient latch arms 14 move inwardly to engage the hook portions 42 with the outer surface 44 of the deflector plate 33 and thereby again latch the valve in its closed position. Repeated openings and closings of the valve 12 are produced in the same manner in response to corresponding changes in ambient temperature.

The sprinkler head embodiment 71 shown in FIG. 5 responds in a similar manner to changes in ambient temperature within a protected zone. However, in this case, the shape-memory alloy coil 70 normally has an axially contracted form rather than the normally expanded form of the alloy coil 17 employed the sprinkler head 11 of FIGS. 1–4. In response to a rise in ambient temperature to above a given transition level of the alloy coil 70, forces are generated that tend to move the coil into an axially expanded form. However, such movement is restrained by the interconnected coil retaining flange 78, the struts 82 and the deflector plate 33 which is in turn restrained by the latch arms 14. A further increase in ambient temperature to above a predetermined transition temperature of the sensor coil 52 causes the sensor 16 and the actuator 15 to outwardly deflect the latch arms 14 and release the valve assembly 12. After release, the valve assembly 12 is moved into an open position corresponding to that of the sprinkler head 11 shown in FIG. 4 by both the fluid pressure in the flow passage 19 and the axial expansion of the alloy coil 70. A subsequent reduction in ambient temperature to below the given transition level of the alloy coil 70 causes contraction thereof into the form shown in FIG. 5. This contraction of the coil 70 draws the interconnected brackets 76, the coil retainer flange 78, the struts 82 and the deflector plate 33 upwardly as described above. Accordingly, the valve assembly 12 is returned to a fully closed position and is automatically latched therein by the resilient latch arms 14.

Obviously, many modifications and variations of the present invention are possible in light of the above teachings. It is to be understood, therefore, that the invention can be practiced otherwise than as specifically described.

What is claimed is:

1. An automatic on-off sprinkler head comprising:

a housing defining inlet and outlet openings;

valve means retained by said housing and disposed between said inlet and outlet openings, said valve means being movable between a closed position in which it prevents fluid flow between said inlet and outlet openings and an open position in which it allows fluid flow therebetween;

temperature responsive shape-memory alloy actuator means shaped and arranged to allow movement of said valve means into said open position in response to ambient temperatures above a given level and to forcibly return said valve means into said closed position in response to ambient temperatures below said given level latch means normally latching said valve means in said closed position, releasable to allow movement thereof to said open position, and shaped and arranged to automatically relatch said valve means in response to return thereof to said closed position;

release means operable to release said latch means and allow movement of said valve means into said open position; and sensor means for operating said release menas in response to a predetermined ambient temperature.

2. A sprinkler head according to claim 1 wherein said predetermined temperature is greater than said given temperature level.

3. A sprinkler head according to claim 1 wherein said valve means comprises a valve head disposed in so as to fluid tightly seal said outlet opening when in said closed position and support means fixed to said valve head and movably retained by said housing, and wherein said alloy means is operatively coupled between said housing and said support means.

4. A sprinkler head according to claim 3 wherein said support means is shaped and arranged to allow movement of said valve head into said open position spaced apart from said outlet opening, and said valve means further comprises deflector means projecting circumferentially from said valve head and adapted to deflect fluid discharging from said outlet opening in a predetermined pattern.

5. A sprinkler head according to claim 4 wherein said housing defines a rectilinear fluid flow passage between said inlet and outlet openings, an annular chamber surrounding said passage, and heat exchange openings allowing air circulation into said chamber, and wherein said alloy means is disposed in said chamber.

6. A sprinkler head according to claim 5 wherein said alloy means comprises a coil member retained in said chamber and surrounding said passage, said coil member tending to assume either a contracted or an expanded state in response to changes in ambient temperature.

7. A sprinkler head according to claim 6 wherein said latch means comprises latch arm means retained by said housing and shaped and arranged to engagably secure said valve means when in a latched position and to allow movement thereof when in a released position, and wherein said release means is retained by said valve means and adapted to move said latch arm means to said released position in response to sensing of said predetermined ambient temperature by said sensor means.

8. A sprinkler head according to claim 7 wherein said sensor means is retained by said valve means.

9. A sprinkler head according to claim 8 wherein said deflector means comprises inner and outer surfaces, said inner surface being disposed adjacent to said housing with said valve means in said closed position, and said latch arm means comprises a pair of latch arms engaging said outer surface when in said latched position.

10. A sprinkler head according to claim 9 wherein said release means comprises a pair of release rods reciprocally mounted on said outer surface and adapted to engage and move said latch arms into said released position in response to sensing of said predetermined temperature by said sensor means.

11. A sprinkler head according to claim 10 wherein said latch arms engage diametrically opposed positions on said outer surface, said release rods are rectilinearly aligned and having inner ends spaced apart thereon, and said sensor means comprises a piston shaped and arranged to engage said inner ends and move the outer ends of said rods into engagement with said latch arms in response to sensing of said predetermined temperature.

12. A sprinkler head according to claim 11 wherein said coil member assumes said contracted state in response to ambient temperatures above said given level and assumes said expanded state in response to ambient temperatures therebelow.

13. A sprinkler head according to claim 12 wherein said housing further defines a housing retainer portion, said support means comprises a coil retainer portion that moves toward said housing retainer portion during movement of said valve means to said open position, and said coil member is disposed between said housing retainer portion and said coil retainer portions.

14. A sprinkler head according to claim 13 wherein said support means further comprises a pair of struts, each having one end fixed to said coil retainer portion and an opposite end fixed to said deflector means.

15. A sprinkler head according to claim 11 wherein said coil member tends to assume said expanded state in response to ambient temperatures above said given level and assumes said contracted state in response to ambient temperatures therebelow.

16. A sprinkler head according to claim 15 wherein said housing further defines a housing retainer portion, said support means comprises a coil retainer portion, and said coil member has one end fixed to said housing retainer portion and an opposite end fixed to said coil retainer portion.

17. A sprinkler head according to claim 16 wherein said support means further comprises a pair of struts, each having one end fixed to said coil retainer portion and an opposite end fixed to said deflector means.

18. A sprinkler head according to claim 6 including a thermal insulator means retained by said housing and disposed between said fluid flow passage and said annular chamber.

* * * * *